United States Patent [19]

Matthews et al.

[11] 4,450,962

[45] May 29, 1984

[54] PACKAGING OR CONTAINING OF BITUMINOUS PRODUCTS

[75] Inventors: John B. Matthews; Roger H. Keller, both of New Plymouth, New Zealand

[73] Assignee: Russell Matthews Industries Limited, New Plymouth, New Zealand

[21] Appl. No.: 366,161

[22] Filed: Apr. 7, 1982

Related U.S. Application Data

[63] Continuation of Ser. No. 125,544, Feb. 28, 1980, abandoned.

[30] Foreign Application Priority Data

Mar. 29, 1979 [NZ] New Zealand ..... 189981
Jun. 6, 1979 [NZ] New Zealand ..... 190646

[51] Int. Cl.[3] ..... B65D 75/48; B65D 85/00

[52] U.S. Cl. ..... 206/447; 206/525; 229/3.5 R; 53/440

[58] Field of Search ..... 206/447, 524.2, 524.3, 206/525, 526, 527; 53/440; 229/3.5 R

[56] References Cited

U.S. PATENT DOCUMENTS 3,645,822 2/1972 Widiger ..... 229/3.5 R
3,667,594 6/1972 Herrell ..... 206/527
3,770,122 11/1973 Thiele ..... 206/524.2
4,205,611 6/1980 Slawinski ..... 206/525

FOREIGN PATENT DOCUMENTS 1066130 1/1957 Fed. Rep. of Germany ... 206/524.3

*Primary Examiner*—William T. Dixson, Jr.
*Attorney, Agent, or Firm*—Murray & Whisenhunt

[57] ABSTRACT

A container for containment of bituminous products formed by inner and outer flexible casings in intimate contact. The inner casing is of a material which has a softening temperature which is above that of the bituminous product when loaded into the container but below that of the bituminous product when it is applied in use, usually by spraying. This inner casing material has a viscosity at the application temperature which enables the material when melted with the bituminous product to be applied therewith.

The outer casing is made from a material which has strength characteristics which enable it to contain the inner casing and bituminous product during the filling of the container as well as during transportation and storage thereof. The outer casing is impervious to movement therethrough of the contained bituminous product, components or additives thereof and preferably has a softening temperature such that melting does not occur at the application temperature.

21 Claims, 3 Drawing Figures

PACKAGING OR CONTAINING OF BITUMINOUS PRODUCTS

Figure 2:
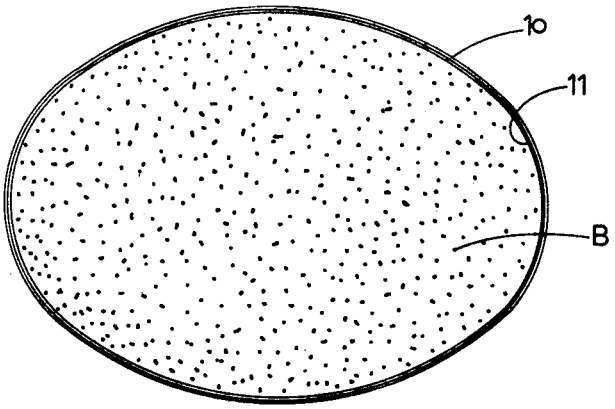

This is a continuation application of Ser. No. 125,544, filed Feb. 28, 1980 now abandoned.

This invention relates to the packaging or containing of bituminous products.

The transportation of bulk bituminous products is normally by sea in shipping tanker vessels and on land in large steel rail or road tankers. These tankers are sometimes insulated to assist in retaining heat energy and may also be equipped with heating tubes and pumping gear. Smaller quantities are usually transported in 150 or 200 liter steel drums or similar containers which must be either broken open or heated by the end user in order to extract the bitumen.

The packaging and transportation costs for bituminous products are thus high, especially when the packaging container may not be suitable for reuse once the bituminous product has been removed or where the container must be returned empty for refilling. It would for example, be desirable to be able to provide a packaging method and means whereby a conventional transportation container could be used for transporting the bituminous product to some destination and then the container be reused, or used for some other purpose. For lighter or less quantities of the bituminous product, it would be desirable to have a packaging method or means whereby the bituminous contents are readily accessible and the packaging means was dispensible.

Many and various attempts have been made to devise packages in which bituminous products may be contained, however, one of the main problems to overcome is to provide some way to prevent the bitumen from adhering to the packaging material. For example, it is known to provide a cardboard container into which the bitumen can be loaded and to prevent the bitumen from adhering to the container a coating of a material to which bitumen will not adhere is applied to the inside of the container. Alternatively, it is known to make the inner liner from a material which will adhere to the bitumen but not the cardboard outer. The liner material in this form is a material which is compatible with the bitumen and can be melted into the bitumen prior to use.

These known packages have in the main not been successful though some limited success has been achieved with high melt temperature bitumens. With roading grade bitumens the problem of movement through the casing arises and this has been one of the main reasons for the failure of previously developed packaging. A further reason arises from the fact that the materials which are compatible with the bitumen and melt with the bitumen on heating and have viscosities on heating which enable them to be applied with the bitumen do not have sufficient tensile strength to contain by themselves the bitumen so that the casing is prone to rupture. For example, this can occur when such casings are being filled with the bitumen or when the ambient temperature during storage or transportation is high.

It is known from prior U.S. Pat. No. 3,366,233 to package bitumen in a single or multilayer container of polyethylene and/or polypropylene film. The object of such a container was to provide a package of bituminous product which when heated to spraying or application temperature the film of the container melted and became mixed with the product itself. A disadvantage in the use of polypropylene is that at spraying temperature the viscosity of the polypropylene is not sufficiently similar to the viscosity of the bitumen to enable it to be sprayed with the bitumen at the temperature at which the bitumen is applied in use.

As disclosed in U.S. Pat. No. 3,366,233 problems arise with movement of components of the bitumen through the polyethylene film. To overcome this problem U.S. Pat. No. 3,366,233 recommends the use of a multilayer container but this does not overcome a further lack of strength problem associated with the use of such polyethylene and polypropylene films as actual containers or for the lining of cardboard or kraft paper containers.

Polyethylenes with the required low melting point characteristics do not have a high tensile strength and thus in a single layer or a thin multilayer arrangement a polyethylene film container by itself is not strong enough to contain bitumen. The tensile strength falls off very quickly as the temperature of the polyethylene rises and thus in climates where the ambient temperature can rise to say 30°–40° C. it is likely the polyethylene film will fail and allow release of the contents. Notwithstanding the temperature/strength problem, polyethylene film containers do not have sufficient strength for satisfactory stacking of such containers for storage or transportation. Polypropylene has only a slightly higher tensile strength than polyethylene and also suffers from the temperature problem described above.

To enable bitumen to be flowed into the packaging container the temperature must be raised to one at which the bitumen can flow. Where a film as proposed in U.S. Pat. No. 3,366,233 is used the temperature of the film on filling with such bitumen also increases and the strength of the film consequently decreases. Once filled the container cannot be moved until the temperature has lowered sufficiently for the container to once more be strong enough to not rupture though as mentioned above a polyethylene film by itself does not provide a sufficiently strong container even at temperatures after cooling of the bitumen. To overcome this problem it has been recommended in U.K. Pat. No. 1,299,161 to support the package in a water bath to prevent the temperature of the container from increasing to a level where its strength is reduced. This method involves high capital cost and is slow and inefficient.

The use of say polyethylene film inside a cardboard or kraft outer is also not successful because oil movement through the film still occurs and can readily stick the inner film to the outer container so that the contents cannot easily be removed. Furthermore oil movement into or through the outer container can lead to such problems as loss of strength of the container, messiness in handling, contamination of other products and fire hazard. Cardboard or kraft containers are also susceptible to water damage and consequent loss of strength unless further protected. Such packaging techniques are also less economic than the packaging of this present invention.

Broadly in one aspect the invention provides a container for containment of bituminous products comprising a first or inner flexible casing located in intimate contact with a second or outer flexible casing, said inner casing being of a material which has a softening temperature greater than the temperature of the bituminous product when it is loaded into said container but lower than the temperature at which the bituminous products are applied in use, said material of the inner casing having a viscosity at said application temperature which enables said inner casing when melted with said bituminous product to be applied therewith, said outer casing being of a material which has strength characteristics which enable it to contain the inner casing and bituminous product during such filling of the package as well as during transportation and storage thereof.

In a second broad aspect the invention provides a method of packaging a bituminous product wherein the bituminous product to be packaged is heated to a temperature at which it is flowable, said product being flowed into the inner flexible casing of a package for containment of the product, said inner casing being located in intimate contact with a second or outer flexible casing and said inner casing being of a material which has a softening temperature greater than the said temperature of the bituminous product but less than the temperature at which the bituminous product is applied in use, said inner casing having a viscosity at said application temperature which enables said inner casing when melted with said bituminous product to be applied therewith, the said outer casing being of a material which has strength characteristics which enable it to contain the inner casing and the bituminous product during the product being flowed into the inner casing, the inner and outer casings being sealed once the bituminous product has been loaded into said inner casing.

The invention thus provides a container for containment of a bituminous product wherein the outer casing prevents the movement of components of the bitumen and other petroleum products that may be contained as additives in the bitumen such as, for example, kerosene, diesel (automotive gas oil) and mineral turpentine.

In the following more detailed description of the invention according to its preferred form, reference will be made to bituminous products which term is understood to include bitumen, asphalt, tar, pitch and bitumen and asphalt mastics, however, the present invention is more particularly relevant to roading or paving grade bitumen.

Figure 1:
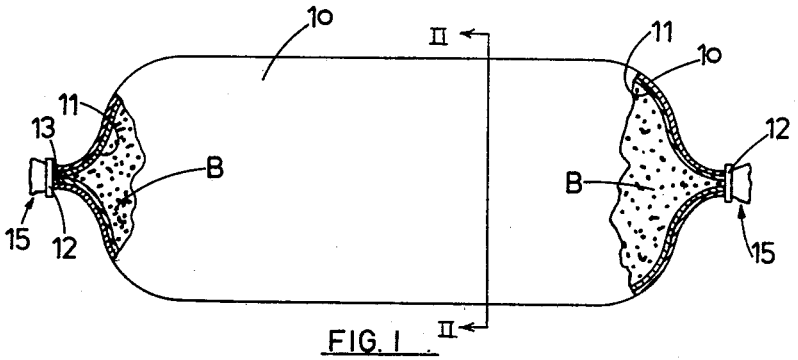
Figure 3:
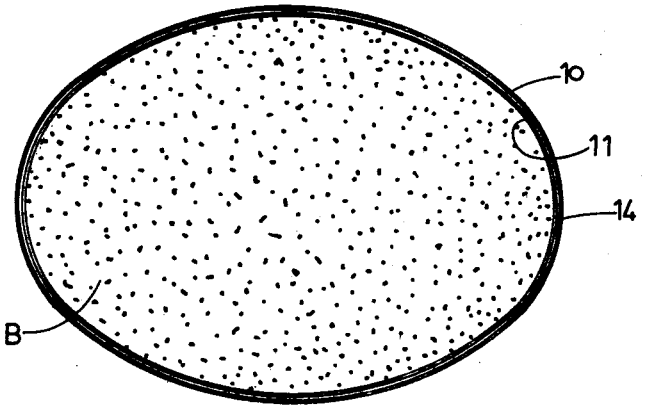

In the following description reference will be made to the accompanying drawings in which:

FIG. 1 is a longitudinal cross-sectioned view of a container according to the invention when filled with a bituminous product, FIG. 2 is a transverse cross-section view on line II—II, and FIG. 3 is a view similar to that of FIG. 2 but showing a further form of the invention.

In the drawings the thickness of the films has been exaggerated in the interest of clarity.

According to the preferred form, the inner and outer flexible casings 10 and 11 respectively are of seamless tubular construction with the inner casing 10 being of a material which is a low density polyethylene with a density of 0.910 to 0.925, or other similar co-polymeric film, and the outer casing material is a high melting polyamide film e.g. polycaproamide (Nylon 6). In the preferred form the polyethylene is of a thickness in the range of 20 to 70 microns (0.02 to 0.07 mm) whilst the polyamide film is 20 to 100 microns (0.02 to 0.1 mm) in thickness. These materials are by way of example only (being suitable for containing road or paving grade bitumens) as other polymer or copolymer materials having the following described characteristics would be suitable. The inner casing material preferably has a softening temperature which lies in the range 60°–120° C. The temperature at which paving grade bituminous products can be sprayed is usually within the temperature range of 100°–180° C. and in this range, the material has melted to a sufficiently low viscosity to enable it to be applied with the bituminous product when it is applied in use. The material is also suitable for use in conjunction with bituminous products in the percentage in which it is present because it has a similar density, is as thermally stable as the bitumen at the temperature at which bituminous products are applied in use, does not significantly alter the elasticity or adhesiveness of the bitumen, nor is it biodegradable. The polyethylene when melted with the bitumen is not poisonous, corrosive or explosive and does not emit volatile or noxious vapours.

The inner casing material is not sufficiently strong to contain the bitumen during filling or permit safe transport, and the outer wall of the casing which is of substantially the same diameter is sufficiently strong to perform the function of containing the inner casing and bitumen. The nylon 6 material has a tensile strength which is high especially at the temperatures at which the bitumen is flowing into the tubing. The high melting point of the nylon is also an asset in the event that by mistake some of it is loaded into the tank of the sprayer. With the high melt point range of 195° C. to 220° C. the nylon does not melt at the spraying temperature at which the bitumenous product is applied. It can therefore be readily removed from the machine or trapped in the filter unit which is a normal component in such spraying machines.

Bitumen may be mixed with diesel (automotive gas oil) or kerosene or turpentine or other petroleum products (such processes known as fluxes, cut backs, blends or additives). Such additives or the components of bitumen do not cause problems by moving through the outer nylon casing. Nylon does not corrode as a metal would, resists hydrolysis and microbiological attack.

Water contamination of bitumen (other than emulsified bitumen) is a serious problem because when the bitumen is heated for use, the water will boil off when the temperature reaches its boiling point and excessive foaming of the bitumen will occur. This foaming bitumen may overflow from the tank with consequent danger to personnel, fire hazard and loss of product and general messiness. The nylon outer casing is waterproof, and thus minimises such problems.

The inner and outer casings 10 and 11 are conveniently constructed as a double walled tubing of the required size and shape and in use a length of the double walled tubing is closed at one end and the bituminous product B is poured into the inner tubing. The outer tubing 11 is in overall intimate contact with the inner tubing 10 so that the inner tubing is thus provided with support during the filling operation. It is preferred, however, that the outer tubing is supported within a rigid mould or former during the filling operation. Once the tubing is filled with the bituminous product B, it is closed and can then be moved immediately into a storage area, stacked or placed into small or large transporting containers. Because the softening point of the inner tubing is above the temperature at which the bituminous product is introduced, no deleterious effects are experienced. While the tensile strength of the inner tubing decreases because of the increase in temperature to the extent whereby it is unable to contain the bitumen by itself this is not a problem as the tensile strength of the outer tubing is great enough to support the inner tubing.

The packaged bituminous product can then be transported to the end user either as separate packages or in containers. The package is not insulated or heated for transportation purposes. Typically, but not exclusively, the packaged product would weigh between 25 kg and 50 kg to facilitate ease of handling. Furthermore, the ends 15 of the casings 10,11 may extend for approximately 100 mm beyond the seals or clips 12, such ends 15 acting as convenient handles.

The ends of the tubing can be sealed by gathering together the end and clipping with a leakproof tie or clamp 12. Alternatively, the end can be placed in a heat sealer which due to the non-compatible nature of the nylon and polyethylene only the inner tube of polyethylene becomes sealed as can be seen at 13. To seal the outer tubing the end is gathered and clipped as aforementioned (see left hand end of container shown in FIG. 1).

To recover the bituminous product, the outer tubing material is stripped off, and the inner tubing material containing the bituminous product is placed in a heating unit (which may also be a sprayer for applying the product) and heated to the application temperature typically in the range 100°–180° C., whereupon the inner tubing material and bituminous product both melt. The resultant product can be applied in the usual manner by spraying to the surface being coated, or mixing with any other products in manufacturing processes. In view of the properties of the inner tubing material noted above, and its small proportion of less than 0.2% weight for weight with the contained bitumen product, the presence of the tubing material in the bituminous product does not significantly affect the physical properties or the effectiveness of the bituminous product. Whilst the low density polyethylene has a viscosity higher than the bituminous product at any temperature its characteristics enable it to disperse into the bituminous product at the normal application temperature range of 100°–180° C. and the resultant product mixture may be applied in the normal manner.

For ease of separation of the inner and outer casings it is desirable that the casings do not adhere to one another. To ensure that they do not adhere to one another a release agent or slip additive can be incorporated.

For example a slip additive can be contained directly in the polyethylene inner casing or the nylon outer casing. With such an arrangement the inner casing can be for example of 60 microns (0.06 mm) thick (it including the slip material) whilst the outer casing is 90 microns (0.09 mm) thick. These dimensions are by way of example only. The inner and outer casing can conveniently be formed in a co-extrusion method.

In a further form (FIG. 3) the inner and outer casings can be formed in a triextrusion method with a slip additive or release agent incorporated as an intermediate layer between the inner and outer casings. This type of container can be achieved by triextruding, for example nylon 6 and low density polyethylene to form the outer and inner casings 10 and 11 and an intermediate film 14 of low density polyethylene slip masterbatch. The compound used in the slip masterbatch can be, for example, Euricamide or an Oleomide as neither will oxidise the bitumen. With such as extrusion of the three layers the thickness of the layers can be, by way of example, 60 microns (0.06 mm) nylon, 20 microns (0.02 mm) low density polyethylene slip masterbatch and 20 microns (0.02 mm) of low density polyethylene.

The invention thus provides a simple but effective and economic method and means for packaging bituminous products. The bituminous product can be readily handled and transported by conventional means of transport such as containers. The outer casing material of the package provides a strong casing through which the contained petroleum products do not move and provides a package that can be packed and stacked and does not stick together. The outer casing can be readily stripped from the inner casing containing the bitumen. The inner casing material of the package containing the bitumen can be readily applied with the bitumen at the temperature at which the bitumen is applied in use obviating the difficulty of removing the bituminous products from conventional containers, including the need for wasteful and inefficient heating and handling thereof.

We claim:

1. A container for packaging roading grade bitumen comprising an inner flexible casing located in intimate contact with a separate outer flexible casing, said inner casing being of a material which has a softening temperature greater than the temperature of the bitumen when the bitumen is loaded into said container but lower than the temperature at which the bitumen is applied in use, the inner casing material having a viscosity at the bitumen application temperature which enables the inner casing when melted with the bitumen to be applied therewith, the outer casing being of a plastic material which does not adhere to the inner casing, has a softening temperature which is such that melting does not occur at the bitumen application temperature, and has a strength characteristic which enables the outer casing to support and contain the inner casing during container filling with bitumen, transportation and storage, but which can be readily stripped from the inner casing to leave the bitumen contained solely within the inner casing.

2. A container as claimed in claim 1, wherein the inner casing material has a density substantially that of the bitumen to be contained therein at the temperature at which the bitumen is applied in use, said inner casing material being non-biodegradable and as thermally stable as the bitumen when held at the temperatures at which the bitumen is stored and applied.

3. Container as claimed in claim 1, wherein the inner and outer casings are of seamless tubular construction and are of substantially the same diameters.

4. Container as claimed in claim 3, wherein the inner casing is formed of a low density polyethylene film and the outer casing is formed of a high melting polyamide film.

5. Container as claimed in claim 4, wherein the polyethylene film is of a thickness in the range of 0.02 to 0.07 mm, and the polyamide film is of a thickness in the range of 0.02 to 0.1 mm.

6. A container as claimed in claim 4, wherein a member selected from the group consisting of release agents and slip materials is incorporated between the inner and outer casings.

7. A container as claimed in claim 4, wherein a member selected from the group consisting of release agents and slip materials is incorporated in at least one of the inner and outer casings.

8. A container as claimed in one of claims 6 or 7, wherein the release agent is a slip material which is a low density polyethylene master batch containing a slip additive.

9. A container as claimed in any one of claims 6 or 7, wherein a low density polyethylene master batch containing a slip additive is incorporated with at least one of the inner and outer casings so as to provide a slip surface at the interface of the inner and outer casings.

10. A container as claimed in claim 4, wherein the inner casing has a softening temperature in the range of 60° to 120° C.

11. A container as claimed in claim 2, wherein the outer casing is impervious to movement therethrough of material contained therein.

12. Container as claimed in claim 4, wherein a slip material is incorporated in the inner casing.

13. Container as claimed in claim 4, wherein a slip material is incorporated in the outer casing.

14. Container as claimed in claim 9, wherein said low density polyethylene master batch containing the slip additive is incorporated with the inner casing so as to provide a slip surface at the interface of said casings.

15. A container as claimed in claim 9, wherein the low density polyethylene master batch containing a slip additive is incorporated into the outer casing.

16. A package of road grade bitumen comprising said bitumen located inside of a container which comprises an inner flexible casing located in intimate contact with a separate outer flexible casing, said inner casing being of a material which has a softening temperature greater than the temperature of the bitumen when the bitumen is loaded into said container but lower than the temperature at which the bitumen is applied in use, the inner casing material having a viscosity at the bitumen application temperature which enables the inner casing when melted with the bitumen to be applied therewith, the outer casing being of a plastic material which does not adhere to the inner casing, has a softening temperature which is such that melting does not occur at the bitumen applicaion temperature, and has a strength characteristic which enables the outer casing to support and contain the inner casing during container filling with bitumen, transportation and storage, but which can be readily stripped from the inner casing to leave the bitumen contained solely within the inner casing.

17. The package of claim 16, wherein the bitumen is contained in a package consisting of a polyethylene inner casing and a polyamide outer casing.

18. Package of claim 16, wherein about 25 to about 50 kg. of bitumen are in said package.

19. A method for packaging, transporting and using road grade bitumen, said method comprising heating the bitumen to be packaged to a flowable temperature, and thereafter flowing said bitumen into a container comprising an inner flexible casing located in intimate contact with a separate outer flexible casing, said inner casing being of a material which has a softening temperature greater than the temperature of the bitumen when the bitumen is loaded into said container but lower than the temperature at which the bitumen is applied in use, the inner casing material having a viscosity at the bitumen application temperature which enables the inner casing when melted with the bitumen to be applied therewith, the outer casing being of a plastic material which does not adhere to the inner casing, has a softening temperature which is such that melting does not occur at the bitumen application temperature, and has a strength characteristic which enables the outer casing to support and contain the inner casing during container filling with bitumen, transportation and storage, but which can be readily stripped from the inner casing to leave the bitumen contained solely within the inner casing, sealing the inner and outer casings after the bitumen has been loaded into the inner casing to prevent escape of said bitumen during transport, transporting the packaged bitumen, removing said outer casing, and heating the inner casing and bitumen packaged therein to melt the inner casing material into the bitumen, and thereafter applying the melted inner casing and bitumen to a road surface.

20. Method as claimed in claim 19, wherein the inner and outer casings are of seamless tubular construction and are of substantially the same diameters, the inner casing being formed of a low density polyethylene film and the outer casing being formed of a nylon film.

21. Method of claim 19, wherein about 25 to about 50 kg. of said bitumen are flowed into said inner flexible casing.

* * * * *